US007385155B2

(12) United States Patent
Trivette et al.

(10) Patent No.: US 7,385,155 B2
(45) Date of Patent: Jun. 10, 2008

(54) APPARATUS FOR SECURING A CONDUCTOR IN A POWER SWITCHING DEVICE

(75) Inventors: Marty L. Trivette, Hartford, CT (US); Oliver Claus, Ratingen (DE); Edgar Dullni, Ratingen (DE); Hoan D. Le, Wendell, NC (US)

(73) Assignee: ABB Technology AG, Zurich (CH)

( * ) Notice: Subject to any disclaimer, the term of this patent is extended or adjusted under 35 U.S.C. 154(b) by 475 days.

(21) Appl. No.: 11/144,286

(22) Filed: Jun. 3, 2005

(65) Prior Publication Data

US 2005/0270718 A1 Dec. 8, 2005

Related U.S. Application Data

(60) Provisional application No. 60/576,475, filed on Jun. 3, 2004.

(51) Int. Cl.
*H01H 33/66* (2006.01)

(52) U.S. Cl. ..... 218/138; 174/153 R

(58) Field of Classification Search ..... 439/736; 218/138, 139; 174/142, 143, 152 R, 153 R
See application file for complete search history.

(56) References Cited

U.S. PATENT DOCUMENTS 2,431,951 A * 12/1947 Mauerer ..... 174/153 R
2,748,187 A * 5/1956 Conrad ..... 174/153 R
2,924,643 A * 2/1960 Barnes ..... 174/178
2,997,530 A * 8/1961 Rosan ..... 174/153 R
3,283,186 A * 11/1966 Perry ..... 310/71
3,792,193 A * 2/1974 Price et al. ..... 174/153 R
3,801,727 A * 4/1974 Wilkinson et al. ..... 174/50
3,812,314 A * 5/1974 Nonken ..... 218/138
4,480,151 A * 10/1984 Dozier ..... 174/153 R
5,879,610 A * 3/1999 Beinhaur et al. ..... 264/274
7,239,490 B2 * 7/2007 Benke ..... 361/2

* cited by examiner

*Primary Examiner*—Neil Abrams
(74) *Attorney, Agent, or Firm*—Michael C. Prewitt; Bryan Shang

(57) ABSTRACT

A power switching device for use in a power distribution network has a conductive element that is shaped in a non-cylindrical form. The non-cylindrical shape of the conductive element allows the non-conductive material such as epoxy that is used to form the body of the device to securely fasten the conductive element in place to thereby keep the conductive element from rotating when excessive rotational force is applied to the conductor. The conductive element can be shaped with a protrusion or in a C-shape. The protrusion and C-shape help prevent rotation of the conductive element when a threaded bolt is applied to secure a power cable to one end of the conductive element.

18 Claims, 5 Drawing Sheets

APPARATUS FOR SECURING A CONDUCTOR IN A POWER SWITCHING DEVICE

CROSS REFERENCE TO RELATED APPLICATION

This application claims the priority of U.S. provisional patent application Ser. No. 60/576,475 filed on Jun. 3, 2004, entitled "Embedded Pole Apparatus," the contents of which are relied upon and incorporated herein by reference in their entirety, and the benefit of priority under 35 U.S.C. 119(e) is hereby claimed

FIELD OF THE INVENTION

The present invention relates to a power switching device and more particularly to an electrical terminal conductor in the power switching device.

BACKGROUND OF THE INVENTION

In the power generation and distribution industry, utility companies generate electricity and distribute the electricity to their customers. To facilitate the process of distributing electricity, various types of power switching devices are used. In a distribution circuit, electricity flows through the power switching devices from a power generation source (typically a substation or the like) to the consumer. When a fault is detected in the distribution circuit, the power switching device is opened and the electrical connection is broken.

Controllers are used by the utility company to detect faults that occur in the distribution circuit. The controller typically uses a microprocessor programmed to respond to the fault based on the type of fault and the type of power switching device connected to the controller. The controller may respond to a particular fault by causing the power switching device to remain open. Alternatively, upon the detection of a fault, the controller may cause the power switching device to open and close multiple times.

The typical voltage ratings for power switching devices range from 1 kilovolts (kV) to 38 kV with current levels up to 63,000 amperes. In order to withstand this amount of power, the power switching devices are constructed out of non-conductive materials such as epoxy or epoxy resins. As the power switching devices are manufactured, the conductive elements are placed within a mold and the non-conductive material, in liquid form, is poured into the mold. As the material cools it solidifies and holds the conductive elements in place. The conductive elements are connected to a connector that extends out of the epoxy housing.

The epoxy and the conductive element have two different coefficients of expansion. As a result, when the epoxy hardens it may not sufficiently adhere to the connector to properly secure the connector in the power switching device. Connectors that are now used in power switching devices are only cylindrical in form and thus the epoxy has only regularly shaped smooth surfaces to adhere to. The present invention provides an irregular shape to the connector to thereby allow additional surface area for the epoxy adhesion.

When the power switching device is wired into the power distribution network, cables are attached and tightened to the connector. The utility company provides guidelines to its personnel for the amount of force necessary to secure the cables. However, these guidelines may not be followed and too much force may be applied by utility personnel when securing the cables. If the connector is not sufficiently secured by the epoxy, the torque resulting from the excessive force may cause the connector to rotate. If the connector rotates, the structure of the power switching device is compromised and the device may experience premature failure. The present invention provides a secure anchor for the connector within the epoxy should excess amounts of torque be applied.

Additionally, during the installation process, compressional forces can be exerted on the connector. The compressional forces may compromise the integrity of the components connected to the connector. The connector of the present invention distributes the compressional forces away from the conductive elements within the power switching device.

SUMMARY OF THE INVENTION

A power switching device for use in transmitting and distributing power, the power switching device having a vacuum interrupter, a non-cylindrical conductor, one end of the non-cylindrical conductor electrically connected to a power source, the other end of the non-cylindrical conductor electrically connected to the vacuum interrupter, the non-cylindrical conductor and the vacuum interrupter are encased in a non-conductive housing.

A conductor for use in a power switching device, the power switching device being installed in a power distribution network, the conductor having a cylindrical portion, a base portion, and a protrusion. The protrusion is connected to the cylindrical portion and the base portion and the protrusion extending radially away from the cylindrical portion.

A power distribution network having a power source connected to a conductor of a power switching device, the conductor having a cylindrical portion, a base portion and a protrusion, the protrusion is connected to the cylindrical portion and the base portion, the protrusion radially extending away from the cylindrical portion.

BRIEF DESCRIPTION OF THE DRAWINGS

The invention is further described in the detailed description that follows, by reference to the noted drawings by way of non-limiting illustrative embodiments of the invention, in which like reference numerals represent similar elements throughout the several views of the drawings, and wherein.

DETAILED DESCRIPTION OF ILLUSTRATIVE EMBODIMENTS

Figure 1:
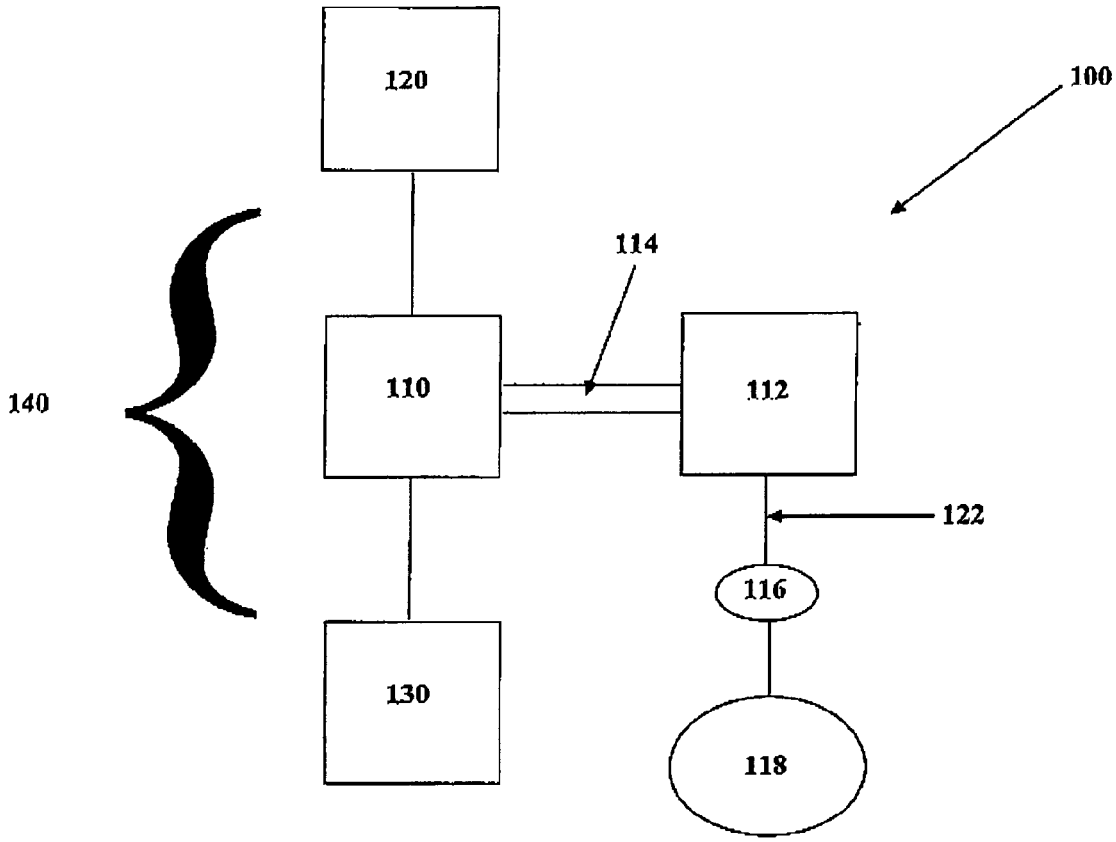
Prior Art Figure 1
FIG. 1 illustrates a block diagram of a typical power switching configuration.

FIG. 1 shows a block diagram of a typical power switching configuration 100. The power switching configuration 100 has a power switching device 110 which is connected in series between a power source 120 and a load 130. The electrical circuit between the power source 120 and the load 130 is referred to as the power distribution circuit 140. The power switching device 110 is connected to a controller 112 by a bidirectional communications bus 114. A user 118 configures the controller 112 and receives information from the controller 112 via a user interface 116. The user interface 116 connects to the controller 112 through a communication means 122.

The power switching device 110 connects the power source 120 to the load 130. A power source 120 used with the present invention is a substation that provides, for example, a 15 kV-38 kV source of three phase AC power. An individual transformer or bank of transformers connected together comprises the load 130. The transformers may be three phase transformers for large industrial applications or single phase transformers used to provide electricity to a residential consumer.

Three types of power switching devices 110 that utility companies use in the power switching configuration 100 are fault interrupters, breakers and reclosers. Each power switching device 110 performs a preprogrammed response when a fault condition in the power distribution circuit 140 is detected by the controller 112. For example, the fault interrupter opens once and remains open when a fault condition is detected. The breaker opens after a fault, but attempts to close before remaining open if the fault continues to exist. A recloser opens and closes multiple times when a fault condition exists. By opening and closing multiple times, the recloser attempts to clear the fault. Should the fault condition continue to exist, the recloser opens and remains open until reset manually. The recloser enters a "lock out" state when this occurs.

A fault condition occurs when one phase of power becomes shorted to ground, phases become shorted to each other, or when lightning strikes the distribution circuit 140. When a fault condition occurs, large amounts of current flow through the power distribution circuit 140. The controller 112 monitors the voltage and current levels communicated to it by the power switching device 110. The power switching device 110 sends this information to the controller 112 through the bidirectional communications bus 114. When an abnormal current level is detected by the controller 112, the controller 112 signals the power switching device 110 to execute the preprogrammed response. Two examples of controllers 112 used with a power switching device 110 that include the present invention are the ICD (Intelligent Control Device) and the PCD (Programmable Control Device), manufactured by ABB Inc.

Figure 2:
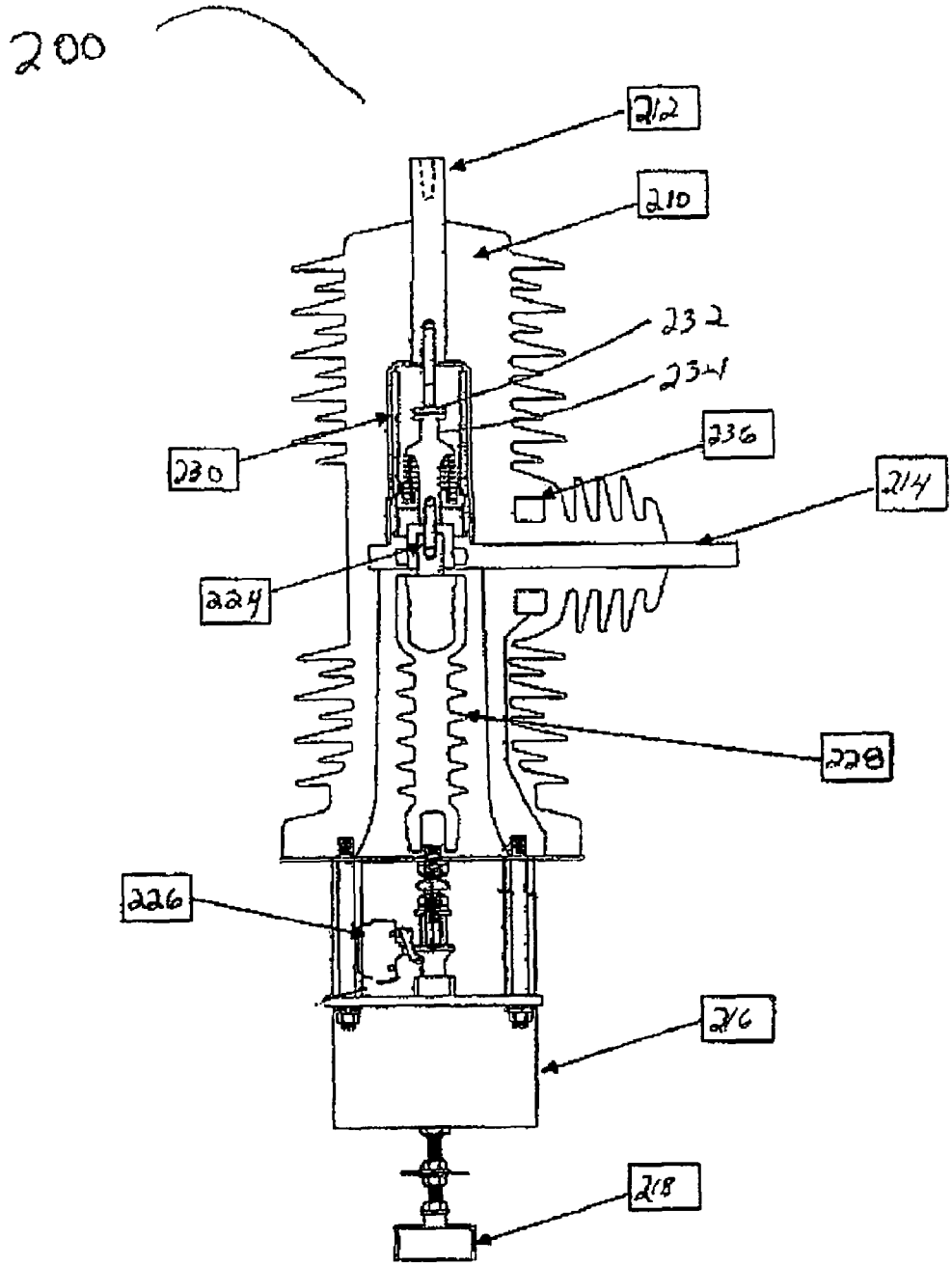
Prior Art Figure 2
FIG. 2 illustrates a cross sectional view of a recloser used in the power generation and distribution industry with a prior art connector.

A cross sectional view of a typical power switching device 110 in the form of a prior art recloser 200 such as the OVR-1 Single Phase Recloser manufactured by ABB Inc. is illustrated in FIG. 2. The recloser 200 has a non-conductive housing 210. Within the housing 210, current flows through the recloser 200 from an H1 connector 212, through a vacuum interrupter 230 and a current transfer assembly 224 to an H2 connector 214. The vacuum interrupter 230 provides an enclosure that houses a stationary contact 232 and a moveable contact 234. The stationary contact 232 is directly connected to the H1 connector 212. The current transfer assembly 224 provides the electrical connection between the moveable contact 234 and the H2 connector 214. The H1 connector 212 is connected to the power source 120.

Mounted around the H2 connector 214 is a power switching current transformer 236. As the AC current flows through the recloser 200, it causes a proportional electrical current to flow through the power switching current transformer 236. The two leads of the current transformer 236 are connected to the bidirectional communications bus 114 which in turn connects to the controller 112. The proportional current from the power switching current transformer 236 is sent to the controller 112 through the bidirectional communications bus 114.

As shown in FIG. 2, the H1 212 and H2 214 connectors are cylindrical in shape and have smooth surfaces. The cylindrical shape provides an even surface area for the epoxy to adhere. The even and smooth surfaces do not provide the epoxy an optimal surface for adhesion. One alternative is to knurl the surface for the H1 212 and H2 214 connectors, thus creating a rough surface and providing the epoxy additional surface area to adhere to. Even by knurling the surface area of the connectors, the epoxy may not provide enough adhesion to securely fasten the connectors 212, 214 in place when external forces are applied to the connector.

The H1 212 and H2 214 connectors protrude out of the housing 210 and are connected to distribution network 140 by power source wires and load wires (not shown) respectively. To facilitate the connection of the H1 connector 212 to the power source 120, the H1 connector 212 is manufactured with a threaded hole (not shown) at its protruding end. The power source wires are secured to the H1 connector 212 by a bolt inserted into the threaded hole and tightened. While not shown, it can be appreciated that top portions of the H1 connector 212 may have a parallel surface to allow the craftsperson to hold the H1 connector 212 in place with a wrench or other securing tool when tightening the bolt. Instead of two parallel sides as shown in FIG. 2, the tops of the H1 connector 212 may be hexagonally shaped. The utility company generally provides guidelines for its installation personnel describing the proper amount of torque to secure the power source wires. If too much torque is applied to the bolt, the excessive force may cause the H1 connector 212 to rotate. If the H1 connector 212 rotates, the recloser 200 may sustain damage to the housing 210 as well as the vacuum interrupter 230. As a result of the damage, the recloser 200 may eventually fail.

Figure 3A:
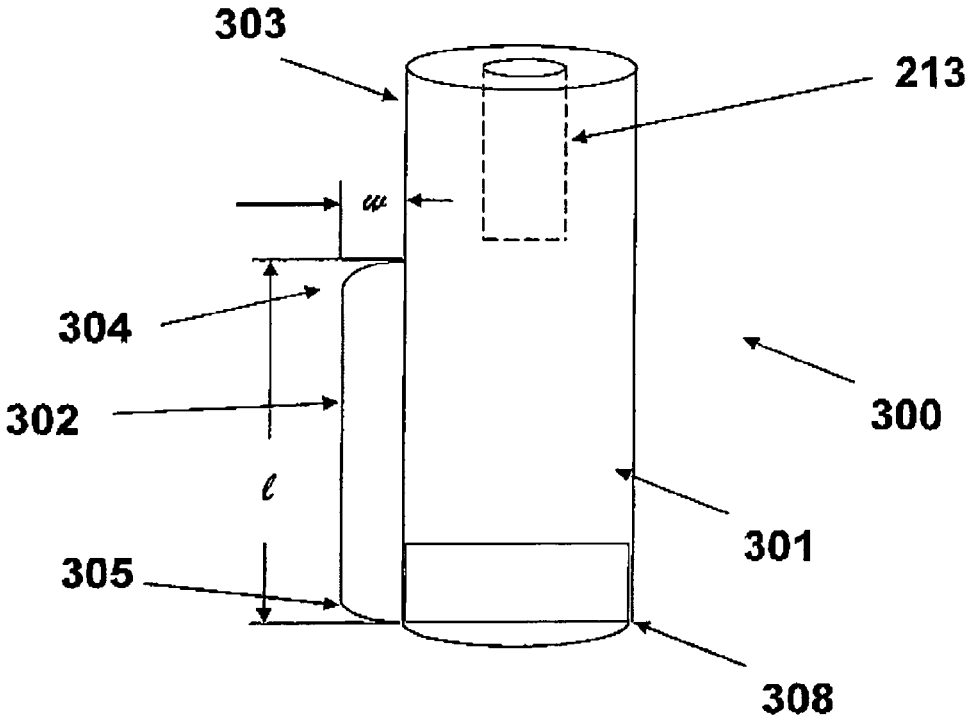
FIG. 3A illustrates a front view of a connector in accordance with one embodiment of the present invention.
Figure 3B:
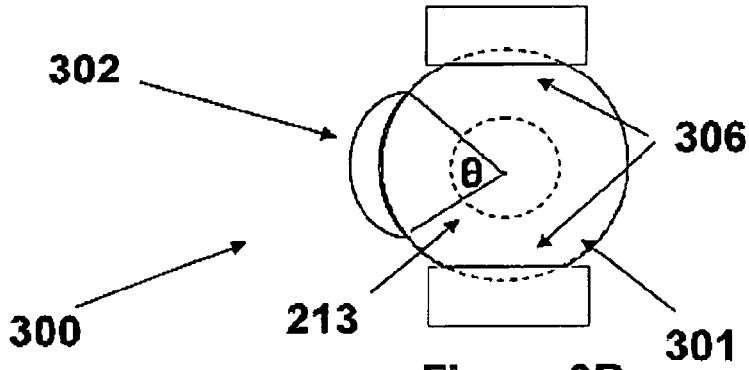
FIG. 3B illustrates a top view of the connector of FIG. 3A.

FIGS. 3A and 3B show an H1 connector 300, in accordance with one embodiment of the present invention. In this embodiment, the connector 300 has a cylindrically shaped core 301, a top portion 303 and a base 308 with a protrusion 302 extending radially outward from the center of the core 301. The protrusion 302 varies in length l, radial width w, and arc angle θ shown in FIG. 3B and acts as an anchor to keep the connector 300 from rotating once the epoxy forming the housing 210 has solidified. The top end 304 and bottom end 305 of the protrusion 302 are tapered. The connector 300 has a threaded hole 213 in the top portion 303 to facilitate connection into the distribution network 140. In the embodiment as shown, the protrusion 302 extends vertically from the base 308 to a point below the top portion 303.

The core 301 and the protrusion 302 can be manufactured as a single piece and out of the same electrically conductive material such as copper or aluminum. Alternatively, the protrusion 302 may be a different type of electrically conductive metallic material and attached to the core 301. For example, an aluminum protrusion 302 may be welded or possibly bolted to a copper core 301.

FIG. 3B shows a top view of the connector 300. From this view, the arc angle θ is clearly shown. The connector 300 has two parallel sides 306 to allow a securing tool to hold the connector 300 in place when connecting the power switching device 110 into the power distribution network 140.

When determining the dimensions of the protrusion 302, factors such as the length and radius of the core 301, as well as the thickness of the housing 210, are taken into account. In one illustrative example, the protrusion 302 has a length l of 2 cm, a width w of 1 cm and an arc angle θ of 60°. In the embodiment of FIG. 3A, the protrusion 302 is fully encased in epoxy and the top end 304 does not extend out of the housing 210.

One important aspect of this embodiment is the lack of sharp edges of the protrusion 302 and the core 301. The combination of the protrusion 302 with the core 301 provides the securing function that is absent in the prior art H1 connectors 212. The irregular shape of the connector 300 acts as an anchor to keep the connector 300 from rotating. The lack of sharp edges reduces the amount of stress the housing 210 experiences when the epoxy hardens. Excess stress during the curing process can lead to stress fractures which also degrade the structural integrity of the connector 300.

Figure 4A:
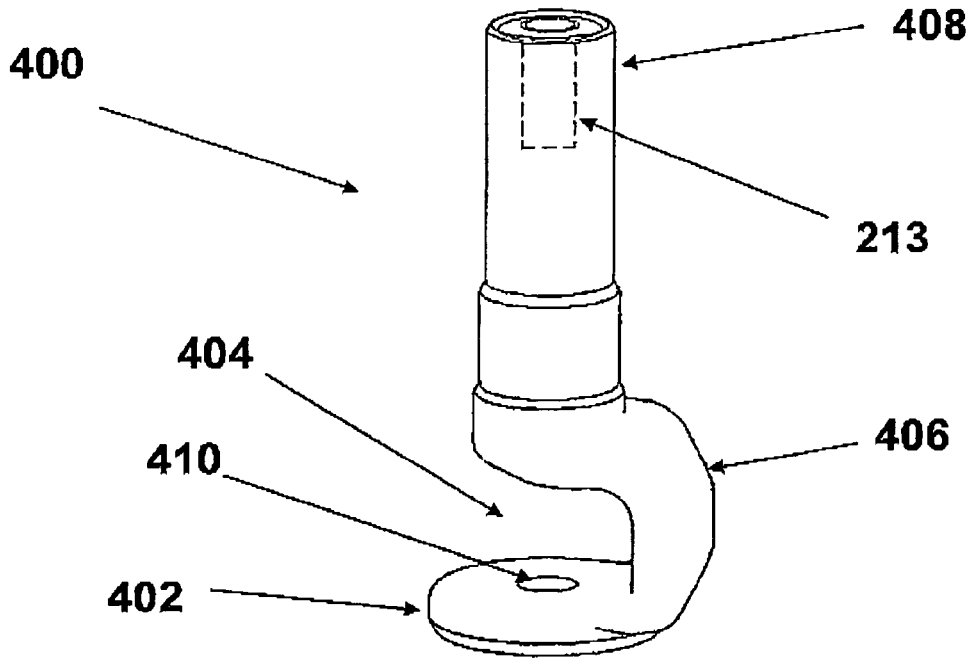
FIG. 4A is a front prospective view of a connector in accordance with an embodiment of the present invention.
Figure 4B:
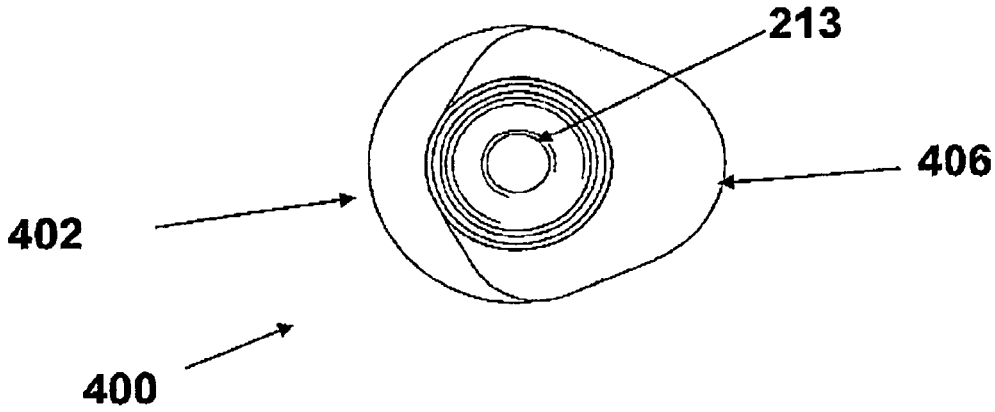
FIG. 4B illustrates a top view of the connector of FIG. 4A.
Figure 4C:
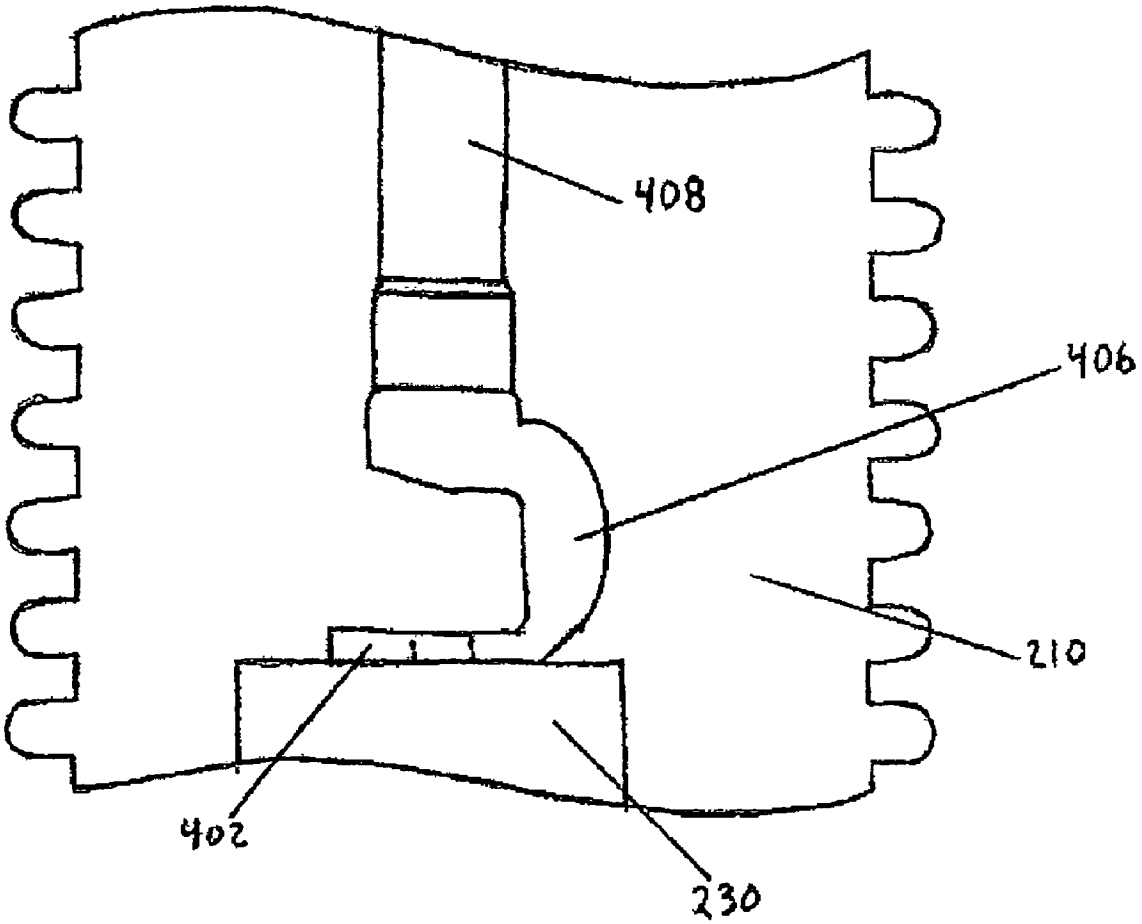
FIG. 4C illustrates a side view of the connector of FIG. 4A within the non-conducting housing.

FIGS. 4A and 4B show another embodiment for a connector 400 in accordance with the present invention. Instead of manufacturing the connector 300 (of FIGS. 3A and 3B) with a protrusion 302 attached connected to a cylindrical core 301, the connector 400 is constructed with a "C-shape" protrusion 406. The C-shaped protrusion 406 provides the same anchoring properties as the protrusion 302 of connector 300 shown in FIGS. 3A and 3B. The connector 400 has a cylindrical top portion 408, a base 402 and a gap 404. In this embodiment, the diameter of the base 402 is greater than the connector 400 above the protrusion. The gap is formed from the protrusion 406 extending radially away from the center of the connector 400. The base 402 attaches to top of the vacuum interrupter 230. The connector 400 also has a threaded hole 213 to facilitate connection to the distribution network 140.

The C-shape protrusion 406 allows compressional forces applied to the top 408 of the connector 400 to be distributed away from base 402. By distributing the compressional force, the vacuum interrupter 230 attached to the base 402 is not subjected to the full brunt of the force. If the full compressional force were to be transmitted through a non C-shaped connector, the stationary contact 232 may become dislodged and the integrity of the vacuum interrupter 230 may be compromised.

In order to distribute the compressional force away from the vacuum interrupter 230, the connector 400 is designed to allow epoxy to flow into the gap 404 during the manufacturing process. Once the epoxy solidifies, it provides a buffering layer between the top 408 and base 402, which is able to absorb a portion of the compressional force.

The base 402 has a mounting hole 410 to allow easy connection to the vacuum interrupter 230. The vacuum interrupter 230 can be manufactured with a mounting bolt (not shown) that extends through the mounting hole 410 and is secured with a nut (not shown). The gap 404 allows manufacturing personnel assembling the recloser 200 easy access to the mounting bolt and nut during the assembly process.

FIG. 4B shows a top view of the connector 400. From this view, the base 402 is shown extending away from the protrusion 406. The connector 400 shown in FIGS. 4A and 4B is one single piece formed of cast copper. Alternatively the connector 400 may be made from aluminum or other conductive material. The top 408 of the connector 400 that extends out of the housing 210 is coated with silver to allow better connectivity with the distribution circuit wires. The silver coating also helps lower the temperature of the connector 400 when current is flowing through the power switching device 110. While not shown in FIG. 4B, the top 408 may be manufactured with the parallel sides similar to the parallel sides 306 as shown in the embodiment of FIG. 3B.

Similar to the connector 300 of FIG. 3A, the connector 400 in FIG. 4A is designed to have a minimal amount of sharp edges. In the preferred embodiment of the connector 400, the protrusion 406, the base 402 and the sides of the connector 400 are constructed with rounded edges. The smooth shape of the connector 400 allows epoxy to form around the connector 400 without the risk of stress fractures.

It is to be understood that the foregoing description has been provided merely for the purpose of explanation and is in no way to be construed as limiting of the invention. Where the invention has been described with reference to embodiments, it is understood that the words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

We claim:

1. A power switching device for use in transmitting and distributing power, said power switching device comprising:

a vacuum interrupter;

a non-cylindrical conductor, one end of said non-cylindrical conductor for electrical connection to a power source, the other end of said non-cylindrical conductor electrically connected to said vacuum interrupter, said non-cylindrical conductor and vacuum interrupter encased in a non-conductive housing, and wherein the non-cylindrical conductor is C shaped.

2. The power switching device of claim 1 wherein the non-cylindrical conductor further comprises a protrusion.

3. The power switching device of claim 1 wherein the non-cylindrical conductor comprises copper.

4. The power switching device of claim 1 wherein the non-cylindrical conductor comprises aluminum.

5. The power switching device of claim 1 wherein the power switching device is a recloser.

6. A conductor for use in a power switching device, said power switching device installed in a power distribution network, said conductor comprising:

a cylindrical portion having a central axis;

a base portion;

a protrusion, said protrusion connecting said cylindrical portion to said base portion, said protrusion being offset from said central axis; and wherein a gap is formed along said central axis between said cylindrical portion and said base portion.

7. The conductor of claim 6 wherein said base portion is disk-shaped and centrally aligned with said central axis.

8. The conductor of claim 6 wherein said base portion, said protrusion and a portion of said cylindrical portion form a C-shape.

9. The conductor of claim 6 further comprising a threaded hole in said cylindrical portion.

10. The conductor of claim 6 further comprising a metallic coating applied to said conductor.

11. A power distribution network comprising:

a power source; and, a power switching device, said power switching device comprising a conductor for connecting to said power source, said conductor having a cylindrical portion having a central axis, a base portion and a protrusion connecting said cylindrical portion to said base portion, wherein a gap is formed along at least a portion of said central axis between said cylindrical portion and said base portion, said base portion, said protrusion and a portion of said cylindrical portion forming a C-shape.

12. The power distribution network of claim 11 wherein the power switching device is a recloser.

13. The power distribution network of claim 11 wherein the power switching device is a breaker.

14. The power distribution network of claim 11 wherein the power switching device is a switch.

15. The power distribution network of claim 11 wherein the power source is a substation.

16. The power distribution network of claim 11 wherein the conductor further comprises a threaded hole in said cylindrical portion.

17. The power distribution network of claim 11 wherein the conductor is coated in a metallic coating.

18. The power distribution network of claim 11 wherein said base portion is disk-shaped and centrally aligned with said central axis.

* * * * *